US007712170B2

(12) United States Patent
Davis

(10) Patent No.: US 7,712,170 B2
(45) **Date of Patent: *May 11, 2010**

(54) SINGLE PATIENT, PERSONAL USE AIR MATTRESS HAVING A SINGLE PERIMETER SEAM

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 1004 days.

This patent is subject to a terminal disclaimer.

(21) Appl. No.: 11/279,359

(22) Filed: Apr. 11, 2006

(65) Prior Publication Data

US 2006/0162086 A1 Jul. 27, 2006

Related U.S. Application Data

(63) Continuation-in-part of application No. 10/998,768, filed on Nov. 29, 2004, now Pat. No. 7,373,680, which is a continuation of application No. 10/638,450, filed on Aug. 11, 2003, now Pat. No. 6,898,809.

(51) Int. Cl.
*A47C 27/08* (2006.01)

(52) U.S. Cl. ..... 5/711; 5/732

(58) Field of Classification Search ..... 5/81.1 R, 5/652.1, 655.3, 625, 706, 711, 712, 713, 5/714, 715, 731, 732, 654

See application file for complete search history.

(56) References Cited

U.S. PATENT DOCUMENTS

| | | | | |
|---|---|---|---|---|
| 2,724,129 | A * | 11/1955 | Pugh | 5/655.3 |
| 4,272,856 | A | 6/1981 | Wegener et al. | |
| 4,517,690 | A | 5/1985 | Wegener | |
| 4,627,426 | A | 12/1986 | Wegener et al. | |
| 5,065,464 | A | 11/1991 | Blanchard et al. | |
| 5,067,189 | A | 11/1991 | Weedling et al. | |
| 5,483,709 | A | 1/1996 | Foster et al. | |
| RE35,299 | E | 7/1996 | Weedling et al. | |
| 5,561,873 | A | 10/1996 | Weedling | |
| 5,598,593 | A | 2/1997 | Wolfe | |
| 5,742,958 | A | 4/1998 | Solazzo | |
| 5,906,019 | A | 5/1999 | McCarthy et al. | |
| 6,073,291 | A | 6/2000 | Davis | |
| 6,374,435 | B1 | 4/2002 | Leininger et al. | |
| 6,415,583 | B1 | 7/2002 | Landi et al. | |
| 6,418,579 | B2 | 7/2002 | Perez et al. | |
| 6,677,026 | B1 | 1/2004 | Yates | |
| 6,898,809 | B2 | 5/2005 | Davis | |
| 2002/0166168 | A1 | 11/2002 | Weedling et al. | |

* cited by examiner

*Primary Examiner*—Michael Safavi
(74) *Attorney, Agent, or Firm*—Duane Morris LLP

(57) ABSTRACT

A single patient, personal use patient transfer mattress is provided including at least a substantially permanently stainable top sheet having a width, a length, and longitudinally oriented peripheral edges and a bottom sheet having the same width, the same length, longitudinally oriented peripheral edges and a plurality of perforations. The longitudinally oriented peripheral edges of the top and bottom sheets are sealingly fastened to one another. A plurality of baffles, each having a width and a length, are attached to an inner surface of the top sheet and an inner surface of the bottom sheet so as to be transversely oriented between the top sheet and the bottom. The baffles along with the widths of the top and bottom sheets define a radially-outwardly curved perimeter wall that is disposed between an edge of the baffles and the sealed peripheral edges of the top and bottom sheets. The radially-outwardly curved perimeter wall has a width y that is determined by the following relationship:

$$\frac{d\pi - x}{2} \leq y$$

where d comprises a height of the longitudinally extensive pontoon and x comprises the width of the baffles.

6 Claims, 4 Drawing Sheets

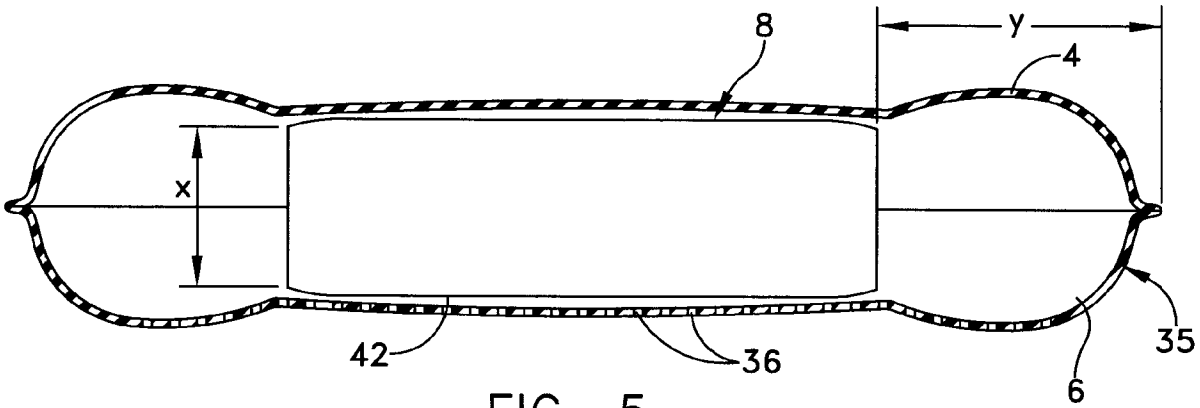
FIG. 5
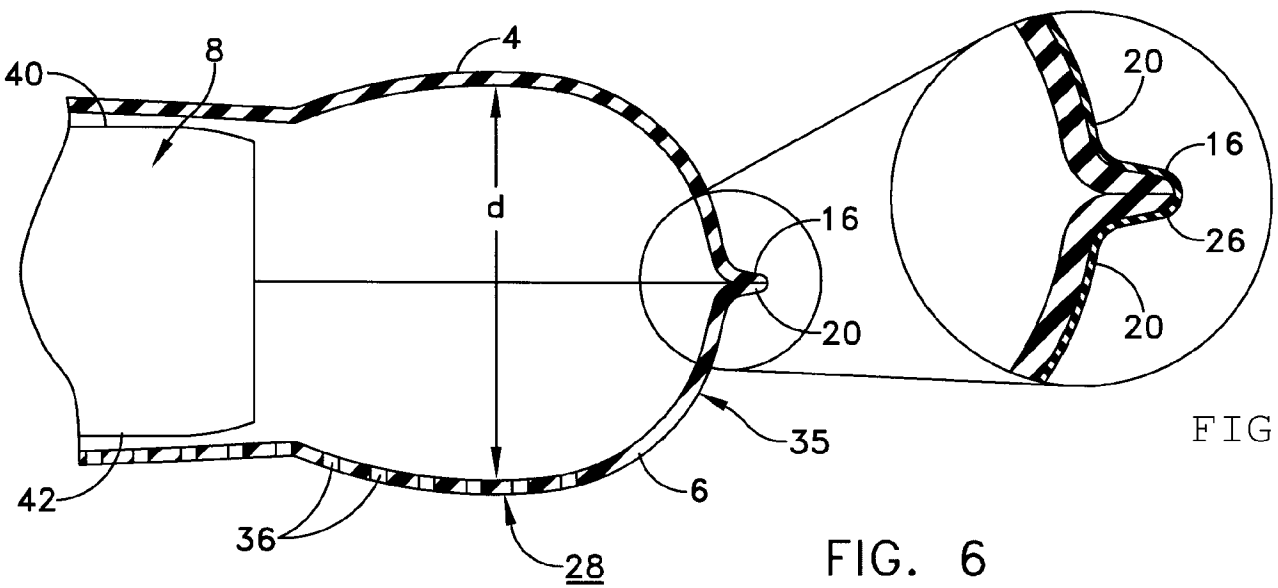
FIG. 6
FIG. 6A

SINGLE PATIENT, PERSONAL USE AIR MATTRESS HAVING A SINGLE PERIMETER SEAM

This application is a continuation-in-part of, and claims priority from application Ser. No. 10/998,768, filed Nov. 29, 2004, which itself is a continuation application of U.S. application Ser. No. 10/638,450, filed on Aug. 11, 2003. and now issued as U.S. Pat. No. 6,898,809.

FIELD OF THE INVENTION

The present invention generally relates to patient transfer devices and, more particularly to a patient transfer apparatus which employs an air bearing to facilitate the transfer.

BACKGROUND OF THE INVENTION

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

For example, in U.S. Pat. No. 4,517, 690, issued to Wegener, an air pallet is disclosed that is formed from upper and lower thin flexible film sheets sealed at their edges to form a plenum chamber. Wegener's air pallet functions to move a load with minimal friction over an underlying generally planar fixed support surface. The bottom thin flexible material sheet is perforated by small diameter perforations such as pin holes at the load imprint area.

In U.S. Pat. No. 5,561,873, issued to Weedling, provides an inflatable flexible pallet within which an array of structurally interrelated inflatable chambers are formed to support a load when inflated. The flexible pallet is configured to resist lateral and longitudinal shrinkage of the load support surface, as well as ballooning and hot dogging. Rotational instability is also reduced by providing a greater load surface support area.

In U.S. Pat. No. 6,073,291, issued to Davis, an inflatable medical patient transfer apparatus is disclosed that has a combination of transverse partition members and a raised perimeter section to reduce deleterious ballooning and uneven inflation as well as quick emergency deflation. Additional differentially inflatable patient rolling chambers are disclosed on the top of the transfer apparatus to provide assistance to medical personnel in beginning to roll patients reclining or lying upon the transfer apparatus, particularly in a deflated condition on a hospital bed.

All of the foregoing devices have needed to be cleaned after each use so as to prevent transmission of disease from their patient engaging surfaces, since they are all intended for multiple uses with multiple patients. Reusable mattresses need to have the material on their outer surfaces that contacts the patient be readily washable, and also be non-absorbent, since patients often experience loss of bodily fluids. None of the foregoing prior art transfer mattresses are appropriate for assuring single use by and personal to a single patient since all are susceptible to some cleaning that would mask the fact that there had been a prior use with the same or different patient. In the medical field, there is a continuing need to easily, safely and comfortably transport an injured person, hospital patient or injured person at the scene of an accident, using an air mattress that is not only suitable for only a single use, by a single patient, but also retains some evidence of that use so as to alert a second user to the mattresses "previously used" status.

SUMMARY OF THE INVENTION

The present invention provides a transfer mattress adapted for single use by and personal to a single patient including a single use top sheet having a width, a length, and longitudinally oriented peripheral edges and a single use bottom sheet having the same width, the same length, longitudinally oriented peripheral edges and a plurality of perforations. The longitudinally oriented peripheral edges of the single use top and bottom sheets are sealingly fastened often by heat sealing, stitching, or adhesives. Each single use sheet may be formed from materials selected from the group consisting of a woven or a matted web of fibers of acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool. A common characteristic of the foregoing and like fibers is their propensity to stain or discolor as a result of contact with blood, urine, feces, hospital strength disinfecting compounds, alcohol, or the like. Additionally, a variety of films may also be used in place of traditional fabrics to form a single patient, personal use transfer mattress when selected from the group consisting of copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, and polyvinylidene chloride. A plurality of baffles, each having a width and a length, are attached to an inner surface of the single use top sheet and an inner surface of the single use bottom sheet so as to be transversely oriented between the top sheet and the bottom. The baffles along with the widths of the top and bottom sheets define a radially-outwardly curved perimeter wall that is disposed between an edge of the baffles and the sealed peripheral edges of the top and bottom sheets. The radially-outwardly curved longitudinally extensive pontoon has an uninflated width y that is determined by the following relationship:

$$\frac{d\pi - x}{2} \leq y$$

where d comprises a height of the longitudinally extensive pontoon and x comprises the width of the baffles.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein:

FIG. 5 is a cross-sectional view, as taken along lines 5-6 in FIG. 2, showing a baffle and a dimensional relationship of a radially-outwardly curved perimeter wall to the mattress as a whole; and FIGS. 6 and 6A are a broken-away cross-sectional view of the single patient, personal use transfer mattress shown in FIGS. 5 and 2, with FIG. 6A showing an enlarged portion so as to illustrate substantially stainable outer surface fibers.

DETAILED DESCRIPTION OF THE PREFERRED EMBODIMENT

Figure 1:
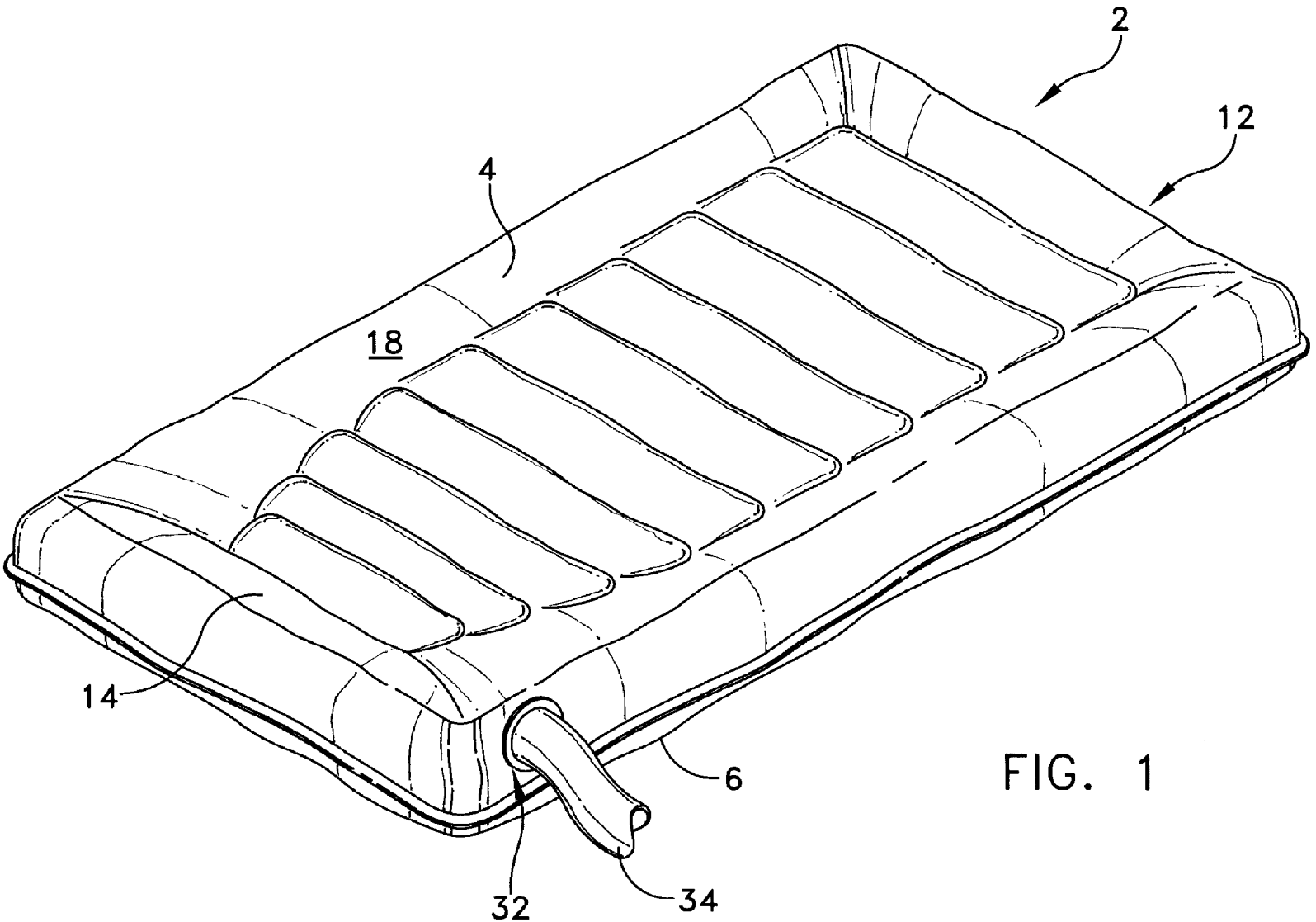
FIG. 1 is a perspective view of a single patient, personal use transfer mattress formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
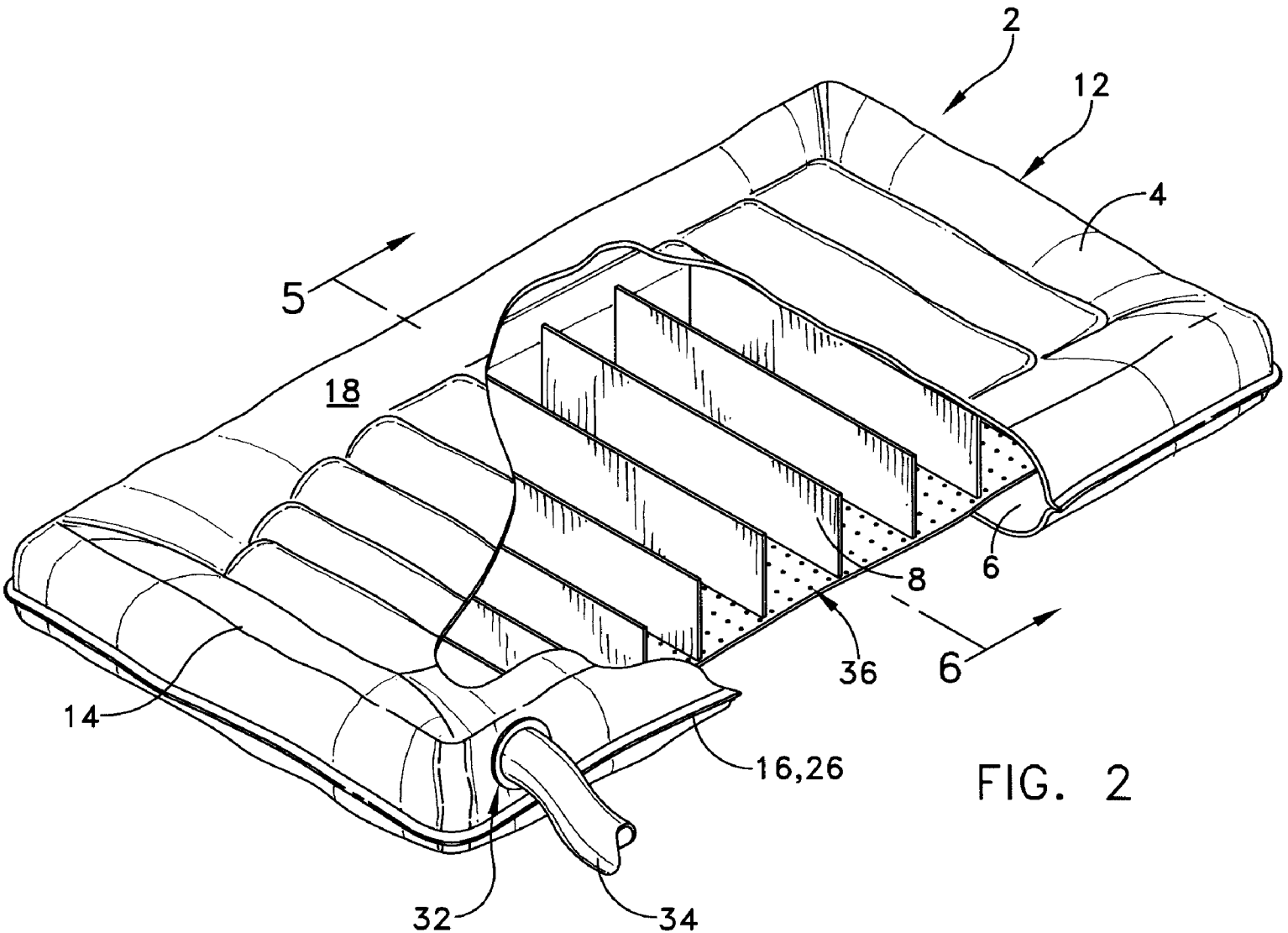
FIG. 2 is a partially broken-way, perspective view of the transfer mattress shown in FIG. 1.
Figure 4:
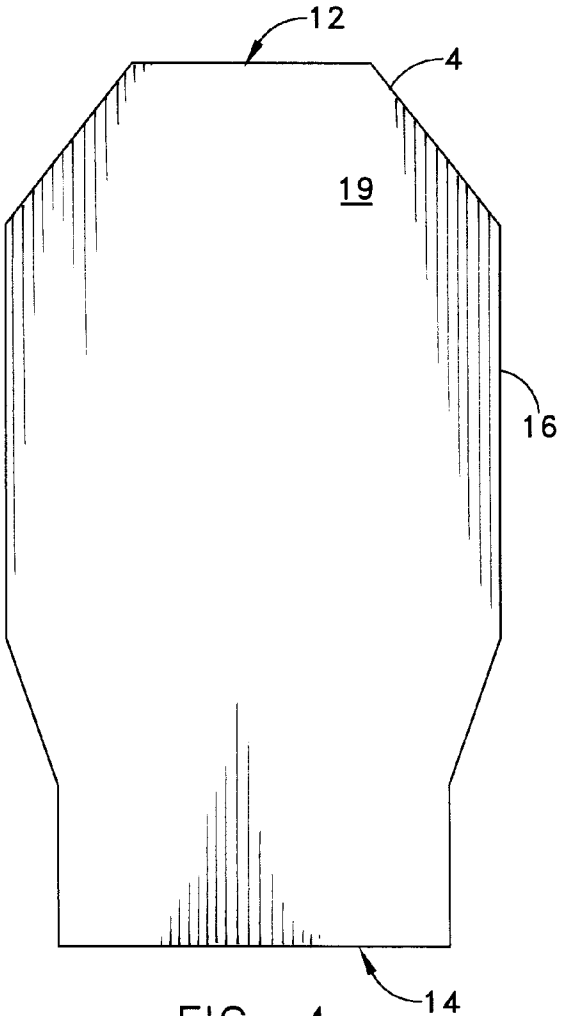
FIG. 4 is a top elevational view of a top panel or sheet formed in accordance with the present invention.
Figure 3:
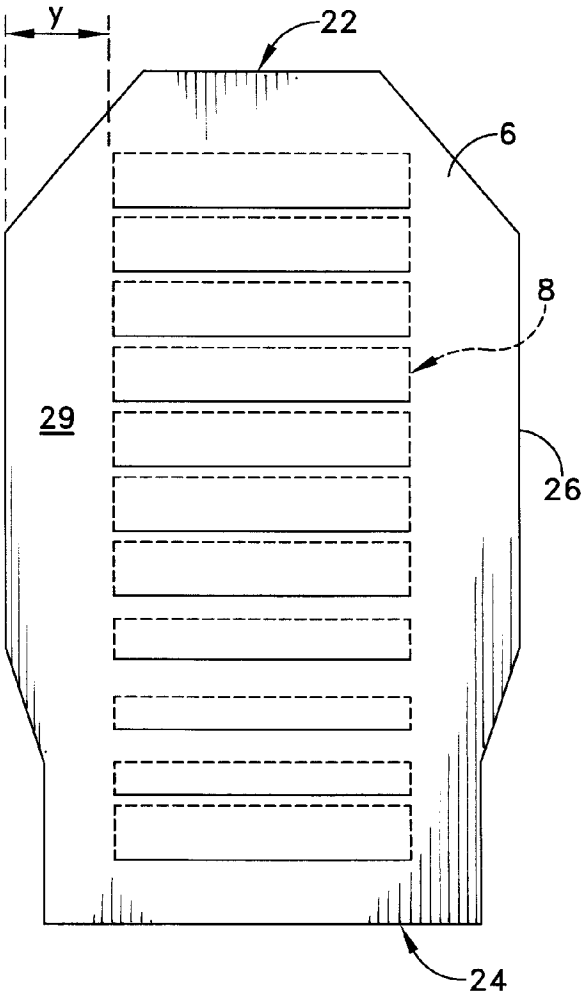
FIG. 3 is a top elevational view of a bottom panel or sheet formed in accordance with the present invention.

Referring to FIGS. 1-4, a single patient, personal use transfer mattress 2 formed in accordance with the present invention comprises a top panel 4, a bottom panel 6, and a plurality of baffle-panels 8. More particularly, top panel 4 comprises a head portion 12, a foot portion 14, and a peripheral edge 16, and is formed from a sheet of substantially stainable fabric, i.e., a woven or entangled mass of fibers, or a film that is highly susceptible to permanent staining by, e.g., semi-solids and liquids, such as, blood, urine, feces, hospital strength disinfecting compounds, alcohol, or the like on outer surface fibers or coatings 20.

In an embodiment of the invention, where patient use lasting less than twenty four hours is desired, fibers for forming fabrics suitable for single use top panel 4 may be made of materials, such as, acetate, acrylic, anidex, aramid, azlon, cotton, elastoester, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool. A common characteristic of the foregoing and like materials is their propensity to stain or discolor as a result of contact with blood, urine, feces, hospital strength disinfecting compounds, alcohol, or the like. Additionally, a variety of films may be used to form a single patient, personal use transfer mattress 2, for example, copolyester, copolyether, ethylene vinyl acetate, fluorocarbon, polyamide, olefins, polybutylene, polycarbonate, polyester, polystyrene, polyurethane, polyvinyl, alcohol, polyvinyl chloride, polyvinyl fluoride, and polyvinylidene chloride. A practical benefit associated with the use of the foregoing preferred materials is that transfer mattresses 2 retain a stained and discolored appearance for longer periods of time after use thereby alerting hospital staff or other care givers that a particular transfer mattress 2 has completed its useful life, and must be discarded.

Bottom panel 6 comprises a head portion 22, a foot portion 24, and a peripheral edge 26, that is also formed from fibers comprising any of the foregoing substantially stainable materials. An inlet opening 32 is formed in a corner portion of transfer mattress 2, and may be a closable opening that sealingly accepts an air supply hose 34. Inlet opening 32 is sized and shaped so that air supply hose 34 may be inserted, with the inlet being thereafter snapped shut or otherwise closed to hold air supply hose 34 in place while transfer mattress 2 is being inflated. Inlet opening 32 may also include a valve (not shown) that is biased to be normally closed to prevent air from exiting through the inlet, and opened when air supply hose 34 is inserted into inlet opening 32. Other arrangements known to those skilled in the art may be used to inflate transfer mattress 2.

Bottom panel 6 also includes a plurality of tiny holes 36 that are defined through its thickness to allow air, that is supplied by a low-pressure air supply to transfer mattress 2, via air supply hose 34, to escape in a controlled manner. The air supplied to transfer mattress 2 escapes through plurality of holes 36, providing a weight-bearing cushion of air that facilitates the sliding of transfer mattress 2 along a surface, as well as, from one surface to another.

Plurality of baffle-panels 8 each comprise substantially rectangular sheets comprising any of the foregoing substantially stainable materials, and include a top edge 40 and a bottom edge 42. Baffle-panels 8 may have differing widths, depending upon their position within transfer mattress 2. Each top edge 40 is fastened transversely to a portion of inner surface 19 of top panel 4, and each bottom edge 42 is fastened transversely to a portion of inner surface 29 of bottom panel 6, as will hereinafter be disclosed in further detail.

A single patient, personal use transfer mattress 2 is assembled according to the present invention in the following manner. Bottom panel 6 is laid out on a suitable support surface so that baffle-panel 8 may be transversely arranged in the center section of inner surface 29. Once in this position, bottom edge 42 of each baffle-panel 8 is fixedly fastened to inner surface 29 of bottom panel 6. Baffle-panels 8 are often heat sealed, sewn, glued, or otherwise bonded together along the interface between bottom edge 42 and inner surface 29 of bottom panel 6. Heat sealing may be done with the application of heat or ultra sonic energy at the edge interface. In this way, an interface structure (FIG. 6) is formed between top edge 16 and bottom edge 26 so as to form a bond that is resistant to rupture under normal loading for a short period of time, i.e., approximately twenty-four to thirty-six hours.

Once plurality of baffle-panels 8 are fastened to inner surface 29 of bottom panel 6, top panel 4 is arranged in overlying confronting relation with bottom panel 6 so that head portion 12 of top panel 4 is confronting head portion 22 of bottom panel 6 and foot portion 14 of top panel 4 is confronting foot portion 24 of bottom panel 6. Once in this position, each top edge 40 of each baffle-panel 8 is fixedly fastened to inner surface 29 of top panel 4.

In order to complete construction of transfer mattress 2, it is necessary to sealingly fasten peripheral edge 16 of top panel 4 to peripheral edge 26 of bottom panel 6 (FIGS. 5-6). Significantly, in order to prevent a person from rolling off transfer mattress 2 during sliding, it has been found to be advantageous to create a radially outwardly curved perimeter wall or "pontoons" 35 that extend longitudinally from head portion 22 to foot portion 24 on either side of baffle-panels 8. Pontoons 35 often comprise a substantially cylindrical shape throughout most of their length, with a substantially circular transverse cross-sectional profile. This provides for a "cradling" effect for the patient. A significant improvement in functionality of transfer mattress 2 is achieved, if pontoon 35 is sized according to the following relationship:

$$\frac{d\pi - x}{2} \leq y$$

where y is the uninflated width of top panel 4 and bottom panel 6 as measured from an edge of baffle-panels 8 to peripheral edges, 16,26; d is the inner diameter of a pontoon 35, i.e., the distance from that portion of top panel 4 that extends from the edge of baffle-panel 8 to peripheral edge 16 and that portion of bottom panel 6 that extends from the edge of baffle-panel 8 to peripheral edge 26, once transfer mattress 2 is inflated; x is the width of a baffle-panel 8; and $\pi$ is the well known geometric/trigonometric constant having an approximate value of 3.14159.

The creation of an appropriately expanded peripheral pontoon 35 adjacent the ends of the transverse baffle-panels 8 provides several advantages. It helps to raise the sides of inflated transfer mattress 2, so as to give the person supported thereon a feeling of security, as well as, actual security in opposing rolling of the person off the inflated device. In addition, the pronounced curvature of pontoon 35 provides for a reduced contact area between mattress 2 and the underlying support surface, so as to reduce drag. A pair of substantially parallel peripheral pontoons 35, located at the ends of transverse baffle-panels 8 provides a slight relative restriction to air passing to the central chambers during inflation, thereby decreasing the tendency of the device to "balloon", i.e., where the load is jacked or raised up so high that it becomes unbalanced on the footprint formed by the central portion of mattress 2. Pontoons 35 also provide for efficient feeding of low-pressure air to all the central chambers defined by baffle-panels 8 at once, effectively encouraging more uniform inflation of those central chambers, even while slightly restricting or slowing down the feeding of air to them. Pontoons 35 also provide enhanced stiffness to the entire transfer mattress, making it easier to handle when inflated. Thus forming pontoon 35 according to this relationship provides for significantly improved sliding movement of transfer mattress 2 during use.

It is to be understood that the present invention is by no means limited only to the particular constructions herein disclosed and shown in the drawings, but also comprises any modifications or equivalents within the scope of the claims.

What is claimed is:

1. A single patient, personal use transfer mattress comprising:

a single use top panel having a width, a length, and longitudinally oriented peripheral edges; and a single use bottom panel having said width, said length, and longitudinally oriented peripheral edges and a plurality of perforations wherein said longitudinally oriented peripheral edges of said top and bottom panels are sealingly fastened wherein at least a portion of said top and bottom panels are formed from sheet of fabric having at least one outer surface comprising a substantially permanently stainable fiber formed from a material selected from the group consisting of acetate, acrylic, anidex, aramid, azlon, cotton, elastoester, fluorocarbon, fur, glass, melamine, metallic, modacrylic, mosacrylic, nylon, nytril, olefin, polyetheretherketone, polyester, polyester-polyarylate, rayon, saran, spandex, sulfar, triacetate, vinal, vinyon, and wool or blends thereof; and further comprising a plurality of baffles each having a width and a length and being attached to an inner surface of said top panel and an inner surface of said bottom panel so as to be transversely oriented between said top panel and said bottom panel, thereby defining a radially outwardly curved longitudinally extensive pontoon disposed between an edge of said baffles and peripheral edges of said top and bottom panels said radially outwardly curved longitudinally extensive perimeter pontoon having a width y that is determined by the following relationship:

$$\frac{d\pi - x}{2} \leq y$$

wherein d comprises a height of said longitudinally extensive pontoon, and x comprises said width of said baffles.

2. A single patient, personal use patient transfer mattress according to claim 1 wherein said plurality of baffles each comprise a substantially rectangular sheet.

3. A single patient, personal use patient transfer mattress according to claim 1 wherein said baffles are fastened transversely to a portion of an inner surface of said top sheet and to a portion of an inner surface of said bottom sheet.

4. A single patient, personal use patient transfer mattress according to claim 1 wherein said longitudinally oriented peripheral edges of said top and bottom sheets are sealingly fastened along their interface.

5. A single patient, personal use patient transfer mattress according to claim 1 wherein said sealingly fastened interface comprises at least one of sewn, glued, or heat and ultra sonic energy.

6. A single patient, personal use transfer mattress comprising:

a single use top panel having a width, a length, and longitudinally oriented peripheral edges; and a single use bottom panel having said width, said length, and longitudinally oriented peripheral edges and a plurality of perforations wherein said longitudinally oriented peripheral edges of said top and bottom panels are sealingly fastened wherein at least a portion of said top and bottom panels are formed from sheet of fabric having at least one outer surface comprising a substantially permanently stainable fiber formed from a material selected from the group consisting of acetate, acrylic, anidex, aramid, azlon, cotton, elastoester, fluorocarbon, fur, glass. melamine, metallic, modacrylic, mosacrylic, nylon, nytril, olefin, polyetheretherketone, polyester, polyester-polyarylate, rayon, saran, spandex, sulfar, triacetate, vinal, vinyon, and wool or blends thereof; and further comprising a plurality of baffles each having a width and a length and being attached to an inner surface of said too panel and an inner surface of said bottom panel so as to be transversely oriented between said too panel and said bottom panel, thereby defining a radially outwardly curved longitudinally extensive pontoon disposed between an edge of said baffles and peripheral edges of said top and bottom panels said radially outwardly curved longitudinally extensive perimeter pontoon having a width y that is determined by the following relationship:

$$\frac{d\pi - x}{2} \leq y$$

wherein d comprises a height of said longitudinally extensive pontoon, and x comprises said width of said baffles, wherein said top and bottom panels are entirely formed from a sheet of substantially permanently stainable fabric formed from an entangled web of fibers.

* * * * *